US006643476B1

(12) United States Patent
Kinouchi et al.

(10) Patent No.: US 6,643,476 B1
(45) Date of Patent: Nov. 4, 2003

(54) IMAGE FORMING APPARATUS WITH ACCURATE TEMPERATURE CONTROL FOR VARIOUS MEDIA HAVING DIFFERENT THICKNESS

(75) Inventors: Satoshi Kinouchi, Tokyo (JP); Osamu Takagi, Chofu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/699,375

(22) Filed: Oct. 31, 2000

(51) Int. Cl.[7] ..... G03G 15/20

(52) U.S. Cl. ..... 399/69; 219/619; 399/92; 399/330; 399/335

(58) Field of Search ..... 399/69, 67, 92, 399/93, 335, 336, 338, 328, 330; 219/619, 672, 676

(56) References Cited

U.S. PATENT DOCUMENTS

| | | | | |
|---|---|---|---|---|
| 4,309,591 | A | * | 1/1982 | Kanoto et al. |
| 4,585,325 | A | * | 4/1986 | Euler ..... 399/69 |
| 4,693,588 | A | * | 9/1987 | Yarbrough et al. ..... 399/93 |
| 5,164,778 | A | * | 11/1992 | Tanabe et al. ..... 399/93 X |
| 5,713,069 | A | * | 1/1998 | Kato ..... 399/330 |
| 5,819,150 | A | * | 10/1998 | Hayasaki et al. ..... 399/330 |
| 5,848,319 | A | * | 12/1998 | Morigami et al. |
| 6,006,051 | A | * | 12/1999 | Tomita et al. ..... 399/69 |
| 6,026,273 | A | | 2/2000 | Kinouchi et al. ..... 399/328 |
| 6,049,692 | A | * | 4/2000 | Hwang ..... 399/336 X |
| 6,078,781 | A | | 6/2000 | Takagi et al. ..... 399/330 |
| 6,087,641 | A | | 7/2000 | Kinouchi et al. ..... 219/619 |
| 6,097,926 | A | | 8/2000 | Takagi et al. ..... 399/328 |
| 6,137,985 | A | | 10/2000 | Kinouchi et al. ..... 399/329 |
| 6,154,629 | A | | 11/2000 | Kinouchi et al. ..... 399/329 |
| 6,198,901 | B1 | * | 3/2001 | Watanabe ..... 399/328 |
| 6,219,504 | B1 | * | 4/2001 | Matsuzaki et al. ..... 399/92 |
| 6,252,212 | B1 | * | 6/2001 | Takagi et al. ..... 399/330 X |
| 6,255,633 | B1 | * | 7/2001 | Takagi et al. ..... 399/330 X |
| 6,263,172 | B1 | * | 7/2001 | Suzuki et al. ..... 399/67 |
| 6,292,647 | B1 | * | 9/2001 | Ishida ..... 399/330 |
| 6,337,969 | B1 | * | 1/2002 | Takagi et al. ..... 399/330 |
| 6,377,775 | B1 | * | 4/2002 | Nakayama et al. ..... 399/328 |
| 6,377,778 | B1 | * | 4/2002 | Kikuchi et al. ..... 399/330 |
| 6,400,924 | B1 | * | 6/2002 | Watanabe ..... 399/328 |
| 6,438,335 | B1 | * | 8/2002 | Kinouchi et al. ..... 399/67 |
| 6,455,824 | B2 | * | 9/2002 | Takagi et al. ..... 219/619 |

FOREIGN PATENT DOCUMENTS

| | | | |
|---|---|---|---|
| JP | 8-76620 | | 3/1996 |
| JP | 9-244465 | * | 9/1997 |
| JP | 9-258586 | | 10/1997 |
| JP | 10-39676 | * | 2/1998 |
| JP | 2000-172100 | | 6/2000 |

* cited by examiner

*Primary Examiner*—Susan S. Y. Lee
(74) *Attorney, Agent, or Firm*—Foley & Lardner

(57) ABSTRACT

Disclosed is a fixing apparatus, in which a cylindrical roller comprising a thin metal layer having a small heat capacity is heated by an induction heating and, when the toner image transferred onto a paper sheet is fixed to the paper sheet, it is possible to control accurately the temperature on the surface of the cylindrical roller. Where the toner image formation on the paper sheet having a width smaller than the length of the cylindrical roller and the fixing operation of the toner image are carried out repeatedly, it is possible to prevent the temperature elevation in the edge portion of the roller. In addition, the power consumption can be saved.

22 Claims, 5 Drawing Sheets

IMAGE FORMING APPARATUS WITH ACCURATE TEMPERATURE CONTROL FOR VARIOUS MEDIA HAVING DIFFERENT THICKNESS

BACKGROUND OF THE INVENTION

The present invention relates to a heating apparatus utilizing an induction heating, particularly, to a fixing apparatus used in, for example, an electrophotographic copying apparatus or a printer apparatus using a toner as a visualizing agent so as to fix the toner image.

In a fixing apparatus incorporated in a copying apparatus using an electrophotographic process, a developing agent image, i.e., a toner image, formed on a transferred material is melted by heating so as to permit the toner image to be fixed to the transferred material. Various methods of heating the toner, which can be employed in a fixing apparatus, have been put to a practical use including, for example, a method utilizing a radiation heat radiated from a halogen lamp (filament lamp), a flash heating method utilizing a flash lamp as the heat source, an oven heating method for heating the entire fixing portion with a heat source, and a hot plate heating system in which plates having a transferred material sandwiched therebetween are heated, a toner image being formed on said transferred material.

In the method using a halogen lamp as a heat source, it is widely known to the art to use a pair of rollers arranged to be capable of applying a predetermined pressure to the transferred material and the toner held therebetween. In this case, at least one of the rollers is formed hollow and a columnar halogen lamp is arranged within the inner space of the hollow roller. In the method of using a halogen lamp, a nip portion is formed between the hollow roller having the halogen lamp arranged therein and the other roller, i.e., a pressurizing roller, and these two rollers are rotated to permit the transferred material having a toner image formed thereon to be guided into the nip portion, with the result that pressure and heat are applied to the transferred material having a toner image formed thereon.

To be more specific, the transferred material, e.g., a paper sheet, having a toner image formed thereon is guided to the nip portion between the hollow heating roller having a halogen lamp arranged therein and the rotating pressurizing roller so as to melt the toner on the paper sheet and, thus, to fix the toner image to the paper sheet.

In the fixing apparatus using a halogen lamp, however, the light and the infrared rays are radiated from the halogen lamp in the entire circumferential direction of the heating roller so as to heat the entire heating roller. As a result, the heat conversion efficiency is 60 to 70% because of the loss in the conversion of the light into heat and the efficiency of warming the air within the heating roller and transmitting the heat to the heating roller, leading to a large power consumption. In addition, a long warming time is required.

Under the circumstances, an improved fixing apparatus has been proposed in recent years. Specifically, it is proposed that a heat resistant film having a thin metal layer (conductor) movable in tight contact with a heating body is formed into an endless belt or a cylinder, and a material to be heated, which is in tight contact with the heat resistant film, is moved together with the film so as to permit the film to impart the heat energy of the heating body to the material to be heated. Incidentally, the heat resistant film has in general a width conforming with the maximum width of the transferred material. It follows that, in the fixing apparatus using the particular film, it is necessary to control the temperature to be uniform in the longitudinal direction of the heating body. As a result, the uniformity in the manufacturing step and the temperature control with a high accuracy in the operating step are required, leading to an increased manufacturing cost of the apparatus.

Incidentally, when it comes to a high speed copying machine capable of making a large number of copies per unit time, the heating time is shortened in general. As a result, it is necessary to use a heating body having a large heat capacity, leading to an increased power consumption. Also, the total power consumption is rendered unduly large so as to give rise to an inconvenience in terms of the safety standards.

In order to overcome the above-noted problems inherent in the heater fixation and the film fixation, a fixing apparatus using an induction heating is proposed in, for example, Japanese Patent Disclosure (Kokai) No. 9-258586 and Japanese patent Disclosure No. 8-76620.

Specifically, Japanese Patent Disclosure No. 9-258586 discloses a fixing apparatus, in which an electric current is allowed to flow through an induction coil prepared by winding a coil about a core arranged along the rotary shaft of the fixing roller made of a metal so as to generate an induction current in the roller and, thus, to permit the metal roller itself to generate heat.

On the other hand, Japanese Patent Disclosure No. 8-76620 discloses a fixing apparatus comprising a conductive film having a magnetic field generating means housed therein and a pressurizing roller that is in tight contact with the conductive film. In this prior art, heat is generated from the conductive film so as to permit the toner image formed on a transferred material, which is transferred through the clearance between the conductive film and the pressurizing roller, to be fixed to the transferred material.

In the fixing apparatus of the induction heating system described above, it is known to the art that the surface temperature is not necessarily rendered uniform in the circumferential direction of the roller body in conjunction with the winding direction of the exciting coil constituting the magnetic field generating device, though the roller body is heated uniformly in the circumferential direction in the known fixing apparatus using a halogen lamp. In other words, the problem is generated that the detected surface temperature is rendered inaccurate depending on the position at which the temperature detecting mechanism is mounted for detecting the surface temperature on the outer circumferential surface of the roller body.

For example, Japanese Patent Disclosure No. 2000-172100 discloses a fixing apparatus, in which an exciting coil is wound about a bobbin to form a solenoid such that the axis of the roller body is equal to the axis of the coil. In this case, the temperature distribution is rendered uniform in the circumferential direction of the roller body, making it possible to detect the surface temperature accurately regardless of the mounting position of the temperature detecting means for detecting the temperature of the roller body on the outer circumferential surface of the roller body. However, the coil of the solenoid type is small in its magnetic flux generating force and, thus, is low in efficiency. In order to increase the efficiency, it is necessary to the number of turns of the coil.

On the other hand, in order to increase the magnetic flux generating force, i.e., to increase the efficiency of the coil, a transverse system has been put to a practical use, in which the winding direction of the coil is allowed to form a plane extending along the circumferential surface of the roller body in order to prevent the magnetic flux generated in the circumferential direction of the roller body from becoming uniform, and the most portion of the wire material forming the coil is allowed to extend in the longitudinal direction of the coil. In this case, distribution takes place in the surface temperature in the circumferential direction of the roller body, making it necessary to mount the temperature detecting mechanism in a position where the surface temperature of the roller body can be detected accurately.

On the other hand, in order to decrease the power consumption (waiting power) by shortening the warm up time, the heat capacity of the roller body is decreased by decreasing the wall thickness of the roller body. However, if a paper sheet differing in size is utilized as a result of decreasing the heat capacity of the roller body, a new problem is generated that the temperature is rendered nonuniform in the longitudinal direction of the roller body. For example, if a paper sheet of a small size, i.e., a paper sheet having a small width relative to the length of the roller body, is consecutively supplied to the fixing device, the heat is not consumed in the edge portion of the roller body, though a large amount of heat is consumed in the central portion of the roller body, giving rise to a problem that the temperature in the edge portion of the roller body exceeds specified temperature. Incidentally, where the roller body has a large heat capacity, the temperature is rendered uniform in the longitudinal direction of the roller body because of the heat conduction. However, where the wall thickness of the roller body is small, it is difficult to eliminate the temperature difference in the longitudinal direction of the roller body.

Under the circumstances, it is disclosed in, for example, Japanese Patent Disclosure No. 9-244465 that a temperature detecting apparatus is mounted to an edge portion of the roller body. It is disclosed that, where the detected temperature exceeds a predetermined value, a cooling fan mounted to an edge portion of the roller body is operated so as to cool the edge portion of the roller body. However, if the roller body is cooled in spite of the temperature in the central portion of the roller body, with the temperature in the edge portion of the roller body used as the threshold value, the temperature in the central portion of the roller body is also lowered. As a result, an additional heating is required so as to increase the power consumption.

Incidentally, in accordance with the recent miniaturization of the image forming apparatus, the fixing apparatus and the image forming portion are arranged close to each other. As a result, the heat of the fixing apparatus brings about a problem that the temperature in the vicinity of the photosensitive body included in the image forming section is elevated to the upper limit of the temperature at which the photosensitive body can be used.

BRIEF SUMMARY OF THE INVENTION

An object of the present invention is to provide a fixing apparatus of the type that a temperature distribution is generated in the circumferential direction of the roller body, in which the temperature of the roller body can be detected accurately.

Another object of the present invention is to provide a fixing apparatus, in which, even if a transferred material is left unremoved within the apparatus in the case where the temperature of the roller body is elevated to an abnormally high temperature, it is possible to detect the abnormal temperature before the transferred material is caused to flame so as to stop the heating of the roller body.

Another object of the present invention is to provide a fixing apparatus capable of cooling an edge portion of the roller body in the case where the temperature elevation has reached a predetermined temperature at the edge portion of the roller body, which takes place in the case where the size of the transferred material differs. In the fixing apparatus of the present invention, the number of cooling operations is made optimum so as to suppress the temperature gradient in the longitudinal direction of the roller body.

Further, still another object of the present invention is to provide a fixing apparatus capable of suppressing the temperature elevation in the periphery of the photosensitive body included in the image forming section while suppressing the temperature difference in the longitudinal direction of the roller body.

According to a first aspect of the present invention, there is provided a fixing apparatus, comprising:

an endless member having a metal layer made of a conductor and rotatable in an optional direction;

a pressurizing member serving to apply a predetermined pressure to the endless member;

an induction heating apparatus arranged in the vicinity of the endless member so as to heat the endless member; and a temperature detecting apparatus for detecting the temperature of the endless member, the temperature detecting apparatus being arranged at a point of about 90° along the outer circumferential surface of the endless member from the pressurizing point at which the pressurizing member applies pressure to the endless member.

According to a second aspect of the present invention, there is provided a fixing apparatus, comprising:

an endless member having a metal layer made of a conductor and rotatable in an optional direction;

a pressurizing member serving to apply a predetermined pressure to the endless member;

an induction heating apparatus arranged in the vicinity of the endless member so as to heat the endless member;

a first temperature detecting apparatus arranged in that position on the surface of the endless member through which passes the minimum size of a transferred material so as to detect the temperature of the endless member;

a second temperature detecting apparatus arranged outside that region on the surface of the endless member through which passes the maximum size of a transferred material so as to detect the temperature of the endless member; and cooling means for cooling the edge portion of the endless member in accordance with the difference in temperatures detected by the first temperature detecting apparatus and the second temperature detecting apparatus.

According to a third aspect of the present invention, there is provided an image forming apparatus, comprising:

a photosensitive body holding a latent image;

a developing apparatus for supplying a developing agent onto the latent image formed on the photosensitive body so as to visualize the latent image;

a transfer apparatus for transferring the developing agent image formed on the photosensitive body by the developing apparatus onto a transferred material;

a fixing apparatus having an endless member including a metal layer formed of a conductor and rotatable in an optional direction, a pressurizing member for applying a predetermined pressure to the endless member, and a heating device arranged in the vicinity of the endless member for heating the endless member, the transferred material having the developing agent image transferred thereto by the transfer apparatus and the developing agent image itself being heated and pressurized so as to fix the developing agent image onto the transferred material; and a cooling apparatus arranged between a first member selected from the endless member and the heating device of the fixing apparatus and a second member selected from the photosensitive body, the developing apparatus and the transfer apparatus, the first member being positioned closest to the second member, for cooling at least one of the edge portion of the endless member and apparatus positioned closest to the second member.

DETAILED DESCRIPTION OF THE INVENTION

A digital copying apparatus will now be described with reference to the accompanying drawings as an example of the image forming apparatus to which is applied the technical idea of the present invention.

Figure 1:
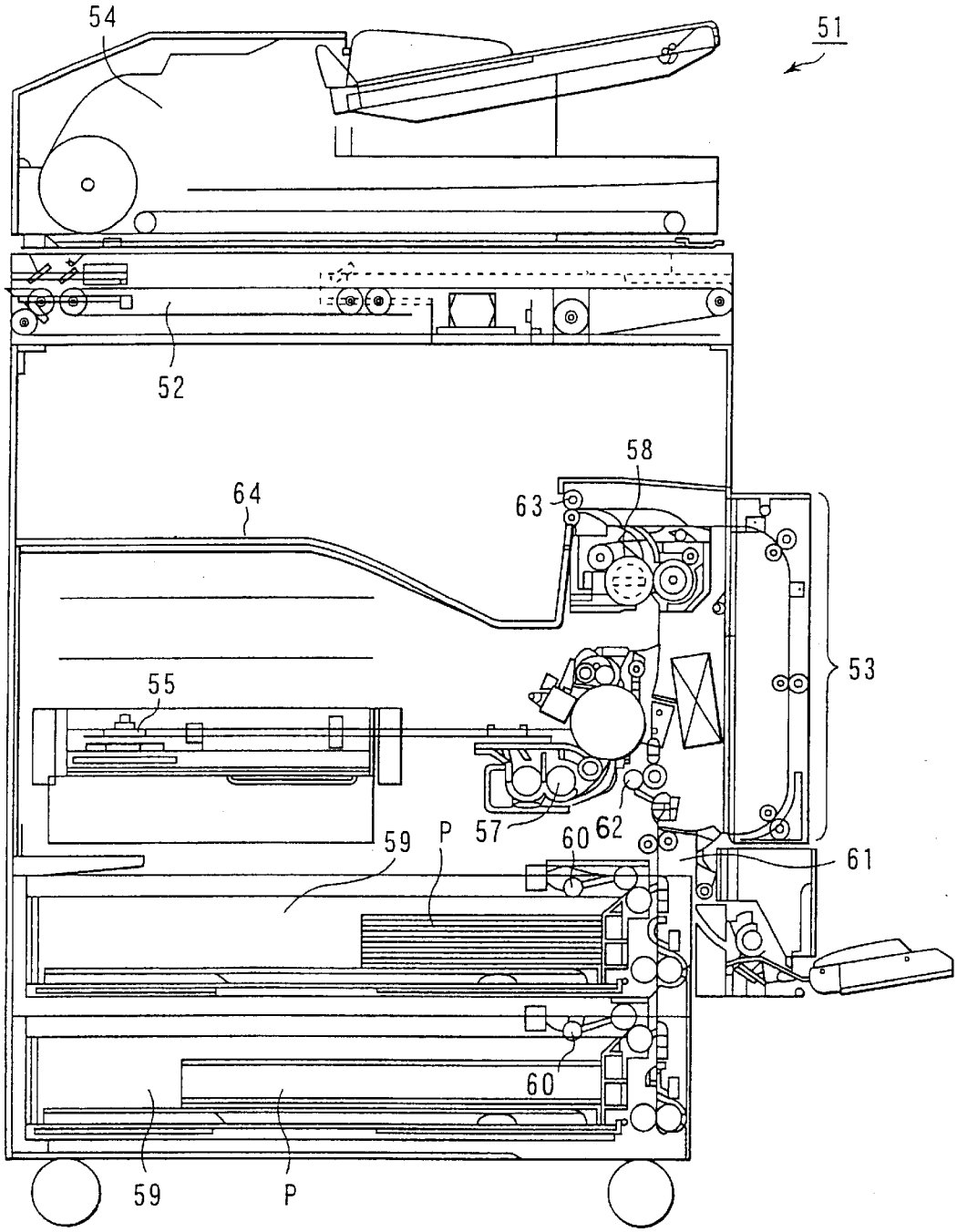
FIG. 1 schematically exemplifies the construction of an image forming apparatus in which an induction heating type fixing apparatus of the present invention is incorporated.

Specifically, FIG. 1 shows a digital copying apparatus (image forming apparatus) 51 of the present invention. As shown in the drawing, the digital copying apparatus 51 has an image reading apparatus (scanner) 52 serving to grasp a subject image as a brightness-darkness of light and to convert the grasped light into an electric signal so as to form an image signal, and an image forming section 53 for forming an image corresponding to the image signal supplied from the scanner 52 or from the outside and for fixing the formed image to a paper sheet P used as a transferred material (transferred material). Incidentally, an automatic original feeding apparatus (ADF) 54 is integrally mounted to the scanner 52. Where the copying object is in the form of a sheet, the automatic original feeding apparatus 54 is interlocked with the image reading operation of the scanner 52 So as to renew successively the copying object.

The image forming section 53 has, for example, a light exposure apparatus 55 for emitting a laser beam corresponding to the image information supplied from the scanner 52 or from an external apparatus, a photosensitive drum 56 for holding a latent image corresponding to the laser beam emitted from the light exposure apparatus 55, a developing apparatus 57 for supplying a developing agent (toner) to the latent image formed on the photosensitive drum 56 for developing the latent image, and a fixing apparatus 58 for fixing the toner image formed by the developing apparatus 57 on the photosensitive drum 57, said toner image being transferred onto a transferred material P by a paper feeding section which is to be described herein later, to the transferred material P by melting the toner image, which is electrostatically attached to the transferred material P, by heating and, then, pressurizing the molten toner image to the transferred material P.

When an image signal is supplied from the scanner 52 or from an external apparatus in the image forming apparatus of the construction described above, the photosensitive drum 56 charged to a predetermined potential is irradiated with a laser beam (not shown) having the intensity modulated to conform with the image signal supplied from the light exposure apparatus 55. As a result, an electrostatic latent image conforming with the image to be copied (to be outputted) is formed on the photosensitive drum 56.

The electrostatic latent image formed on the photosensitive drum 56 is developed with the toner supplied selectively from the developing apparatus 57, with the result that the electrostatic latent image is converted into a toner image (not shown).

The toner image formed on the photosensitive drum 56 is transferred onto a paper sheet P supplied from a paper sheet cassette 59 holding the paper sheets P acting as the transferred materials to the transfer position. The paper sheet P is taken up one by one from the paper cassette 59 by a pickup roller 60 so as to be transferred along a transfer path 61 formed between the photosensitive drum 56 and the cassette 59. The paper sheet P is further transferred to the transfer position for transferring the toner image onto the paper sheet P by an aligning roller 62 for aligning the paper position with the toner image formed on the photosensitive drum 56.

The paper sheet P having the toner image transferred thereonto by the transfer apparatus is transferred to the fixing apparatus 58. The toner image on the paper sheet P is melted in the fixing apparatus 58 and, then, pressure is applied to the molten toner image so as to fix the toner image to the paper sheet P.

The paper sheet P having the toner image fixed thereto in the fixing apparatus 58 is transferred through a paper discharge roller 63 into a discharge space (paper discharge tray) 64 defined between the scanner 52 and the paper sheet cassette 59.

Figure 2A:
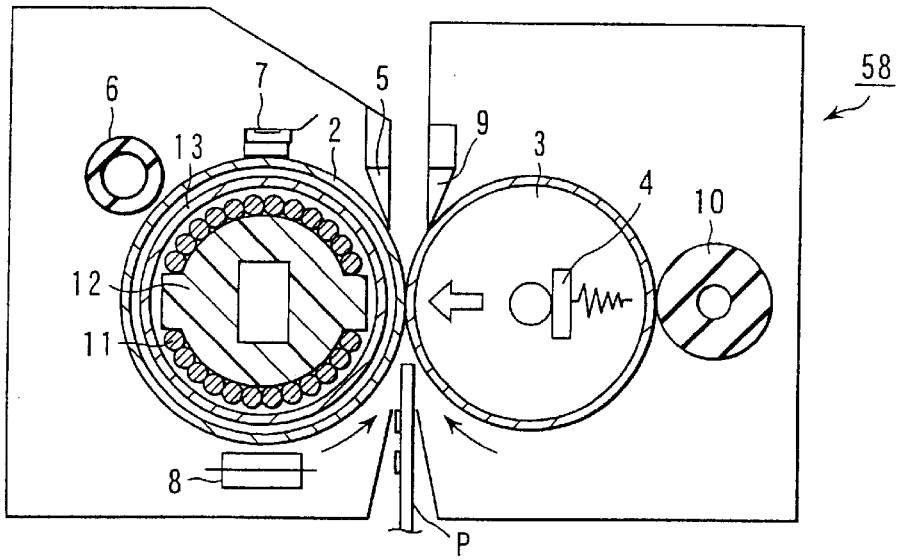
FIG. 2A is a cross sectional view exemplifying the construction of an induction heating type fixing apparatus of the present invention, which is incorporated in the image forming apparatus shown in FIG. 1.
Figure 2B:
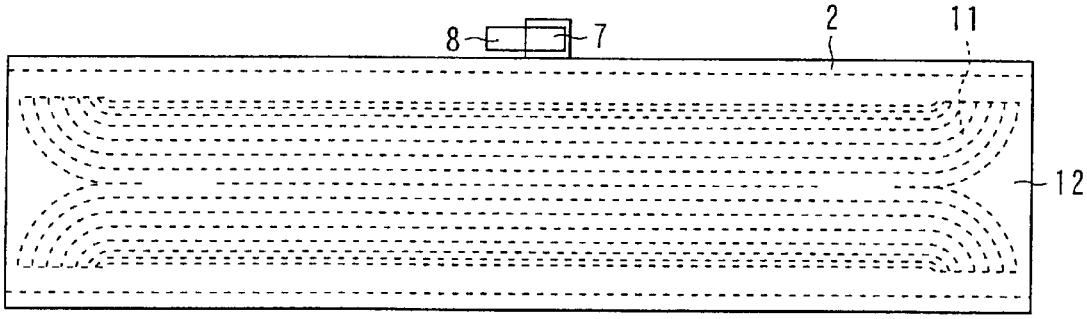
FIG. 2B is a side view exemplifying the construction of an induction heating type fixing apparatus of the present invention, which is incorporated in the image forming apparatus shown in FIG. 1.
Figure 2C:
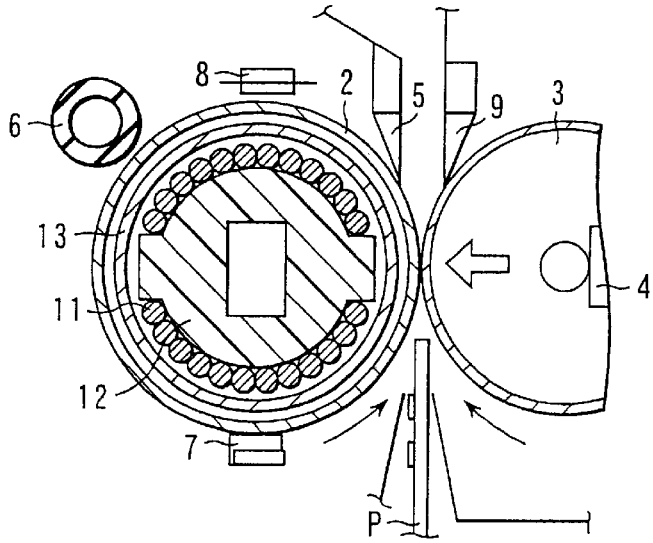
FIG. 2C is a cross sectional view schematically showing a change in the induction heating type fixing apparatus shown in FIG. 2A.

FIGS. 2A, 2B and 2C are cross sectional views schematically exemplifying the construction of the fixing apparatus incorporated in the image forming apparatus shown in FIG. 1.

As shown in FIG. 2A, the fixing apparatus 58 has a first cylindrical roller (heating roller) 2 formed of a metal sheet having a thickness of about 1 mm, having a diameter of about 40 mm, and having a length of about 340 mm, and a second roller (pressurizing roller) 3 having a diameter of about 40 mm and a length of about 320 mm. The axis of the second roller 3 is parallel to the axis of the first heating roller 2 and extends in the longitudinal direction of the heating roller 2. Also, the second roller 3 is in contact with a single point on the circumferential surface of the heating roller 2. It is possible for the heating roller 2 to be formed of, for example, pure iron, stainless steel, aluminum and an alloy between stainless steel and aluminum. Also, a release layer made of a fluorine-containing resin represented by, for example, "Teflon" (trade name of polytetrafluoroethylene) is formed on the surface of the heating roller 2 in order to inhibit the toner attachment to the surface of the heating roller 2. On the other hand, the pressurizing roller 3 is formed of an elastic roller comprising a shaft having a predetermined diameter and a silicone rubber layer or a fluorine-containing resin layer formed on the outer circumferential surface of the shaft.

The pressurizing roller 3 is pushed by a pressurizing mechanism 4 toward the heating roller 2 with a predetermined pushing force. As a result, the pressurizing roller 3 is temporarily deformed so as to form a nip portion between the pressurizing roller 3 and the heating roller 2. Naturally, a predetermined pressure is applied to the paper sheet P, i.e., a transferred material, guided to the nip portion. Incidentally, the heating roller 2 is rotated at a predetermined speed by a driving motor (not shown) such that the outer circumferential surface of the heating roller 2 is moved at a peripheral speed substantially equal to that of the outer circumferential surface of the photosensitive drum 56 included in the image forming section. The pressurizing roller 3 is also rotated in accordance with rotation of the heating roller 3 such that the outer circumferential surface of the pressurizing roller 3 is moved at a peripheral speed equal to that of the outer circumferential surface of the heating roller 2.

A peeling claw 5 for peeling the paper sheet P from the heating roller 2, a cleaning member 6 for removing the toner attached to the heating roller 2, the paper dust generated from the paper sheet P, etc., a thermistor 7 for detecting the temperature on the surface of the heating roller 2, and a thermostat 8 for detecting the abnormality of the temperature on the surface of the heating roller 2 so as to stop the heating (power supply) are arranged on the circumferential surface of the heating roller 2 at predetermined positions on the downstream portion relative to the nip portion between the heating roller 2 and the pressurizing roller 3. Incidentally, the thermistor 7 and the thermostat 8 are arranged in those portions of the outer circumferential surface of the heating roller 2 which are parallel to the direction in which the pressurizing roller 3 is pushed by the pressurizing mechanism 4 and are about 90° apart from the nip portion between the heating roller 2 and the pressurizing roller 3 along the outer circumferential surface of the heating roller 2. In this case, it is possible to arrange the thermistor 7 and the thermostat 8 outside the region of 90° from the nip portion on the circumferential surface of the heating roller 2. For example, it is possible to arrange the thermistor 7 and the thermostat 8 at optional positions within a region of, for example, 85 and 95° or within a region of 80 to 100° from the nip portion on the circumferential surface of the heating roller 2.

FIG. 2A shows that the thermistor 7 and the thermostat 8 are arranged with a phase difference of 180° with respect to the axis of the heating roller 2. It is also possible to arrange the thermistor 7 and the thermostat 8 on the side of the same phase in a central portion of the region, through which the paper sheet P is transferred, in the longitudinal direction of the heating roller 2, as shown in FIG. 2B. These thermistor 7 and thermostat 8 are arranged slightly deviant form each other. The particular construction makes it possible to detect the temperature on the surface of the heating roller 2 more accurately. In the embodiment shown in FIG. 2A, the thermistor 7 is arranged on the downstream side in the rotating direction of the heating roller 2 relative to the nip portion between the heating roller 2 and the pressurizing roller 3. Alternatively, it is also possible to arrange the thermistor 7 on the side on which the thermostat 8 is arranged. It is also possible to arrange the thermostat 8 in an upper portion toward which the heat generated from the heating roller 2 is transferred by convection, i.e., in a position above the heating roller 2 within the image forming apparatus 51, as shown in FIG. 2C. In this case, it is possible to detect the heat transferred upward by convection in the shortest time and at the highest temperature.

A peeling claw 9 for peeling the paper sheet P from the pressurizing roller 3 and a cleaning member 10 for removing the toner attached to the surface of the pressurizing roller 3 are mounted on the circumferential surface of the pressurizing roller 3.

An exciting coil 11 is arranged along the inner circumferential surface of the heating roller 2. The exciting coil 11, which is an empty coil that does not include, for example, a ferrite core or an iron core for converging the magnetic flux generated from the coil 11, is fixed at a predetermined position inside the heating roller 2 by a support member 12 made of an engineering plastic material having a high resistance to heat such as PEEK (poly ether ether ketone), a phenolic material, or an unsaturated polyester. Also, the support member 12 is fixed at a predetermined position by a holder (not shown) for supporting the heating roller 2 such that the exciting coil 11 is not brought into contact with the inner circumferential surface of the heating roller 2. Since an empty coil is used as the exciting coil 11, it is possible to save the cost of the core material having a complex shape. It is also possible to form the exciting circuit at a low cost in the case where an empty coil is used as the exciting coil 11.

The exciting coil 11 is formed of a Litz wire prepared by bundling a plurality of copper wires each having a diameter of 0.5 mm, which are insulated from each other by a heat resistant polyamide imide. In the example shown in the drawing, 16 insulated copper wires are bundled together to form the Litz wire. Where the exciting coil is formed of a Litz wire as in the present invention, it is possible to make the wire diameter smaller than the permeating depth of the skin effect that is generated when an AC current having a high frequency is allowed to flow through the coil. It follows that it is possible to allow a high frequency current to flow through the exciting coil 11.

The surface of the exciting coil 11 is covered with an insulating covering member 13 having a predetermined thickness in order to maintain insulation between the exciting coil 11 and the heating roller 2. The insulating covering member 13 is made of a heat resistant resin. In this embodiment, PET (polyethylene terephthalate resin) is formed into a tube for preparing the covering member 13. It is also possible to use, for example, a fluorine-containing resin, PI (polyimide resin), PPS (polyphenylene sulfide), or a silicone rubber for forming the covering member 13. Incidentally, the covering member 13 is colored white or gray so as to permit the covering member 13 to reflect the infrared ray with a high reflectivity.

The thickness of the covering member 13 is set at 0.3 mm in order to prevent the exciting coil 11 from being broken by contact with the heating roller 2 or to prevent the covering member 13 from being peeled off in the step of renewing the exciting coil 11. Also, the length of the covering member 13 should be shorter than the entire length of the heating roller 2 and should be long enough to cover completely the length of the exciting coil 11 in the longitudinal direction.

The paper sheet P having the toner image, which is formed in the image forming section of the image forming apparatus shown in FIG. 1, transferred thereto is guided to the nip portion between the heating roller 2 and the pressurizing roller 3. As a result, the toner image on the paper sheet P is heated and melted, with the result that the molten toner image is fixed to the paper sheet P by the pressure applied between the heating roller 2 and the pressurizing roller 3.

Figure 3:
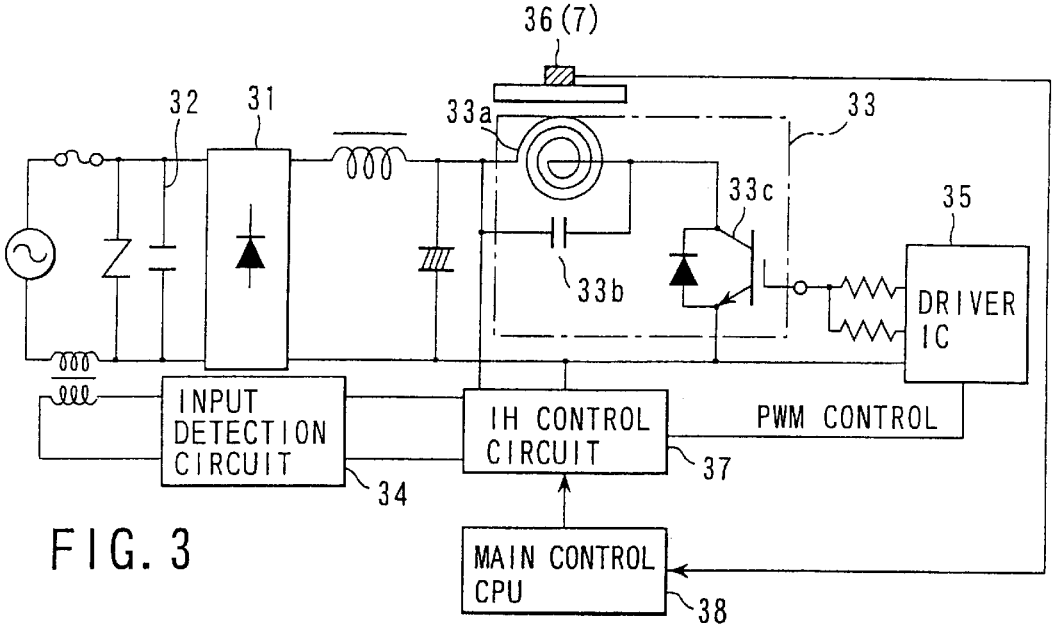
FIG. 3 is a block diagram showing a driving circuit for driving the fixing apparatus shown in each of FIGS. 2A, 2B and 2C.

FIG. 3 is a block diagram schematically showing a driving circuit 30 for driving the fixing apparatus shown in FIGS. 2A, 2B, and 2C. The driving circuit 30 serves to supply a high frequency current to an exciting coil 33*a*, which corresponds to the exciting coil 11 shown in FIGS. 2 and 3. Specifically, the current obtained by rectifying the AC current from a commercial power source by a rectifying circuit 31 and a smoothing capacitor 32 is converted into a high frequency current by an inverter circuit 33 consisting of a resonant capacitor 33*b* and a switching circuit 33*c*. The high frequency current thus obtained is supplied to the exciting coil 33*a*. Incidentally, the magnitude of the high frequency current can be controlled by making the ON time, during which the switching element 35 is kept turned on, variable by the PWM (pulse width control) based on the result of the detection by an input detection circuit 34. In this step, the driving frequency is changed.

Also, it is possible to input the information from a temperature detector 36, which corresponds to the thermistor 7 shown in FIGS. 2A, 2B and 2C, for detecting the coil temperature and the roller temperature directly to an IH (induction heating) circuit 37. Alternatively, it is possible to input the information from the temperature detector 36 to a CPU 38 as in the present invention and, then, to the IH circuit 37 via a D/A converter (not shown) as an ON/OFF instruction.

If a high frequency current is applied to the exciting coil 11 of the fixing apparatus 58, a magnetic flux and an eddy current are caused to be generated within the heating roller 2 by the magnetic flux generated by the current flowing through the coil 11 in a manner to obstruct the change in the magnetic field. A Joule heat is generated by the eddy current and the resistance of the heating roller 2 itself so as to heat the heating roller 2. Incidentally, in this embodiment, a high frequency current having a frequency of, for example, 25 kHz and an output of 900 W is allowed to flow through the exciting coil 11.

As described above, a predetermined high frequency current is supplied from the driving circuit shown in FIG. 3 to the exciting coil 11 of the fixing apparatus 58 shown in FIGS. 2A, 2B and 2C. As a result, the surface temperature of the heating roller 2 is elevated to 180° C. and the elevated temperature is maintained. In this step, the surface temperature of the heating roller 2 is detected by the thermistor 7, and the detected temperature is fed back so as to turn the high frequency current supplied to the exciting coil 11 ON/OFF, thereby maintaining substantially constant the temperature of the heating roller 2.

In order to fix the toner image to the paper sheet P, it is necessary to maintain substantially constant the temperature of the heating roller 2 over the entire region of the heating roller 2 in the circumferential direction. However, where the heating roller 2 is not rotated, the temperature distribution in the circumferential direction of the heating roller 2 is rendered nonuniform, i.e., the temperature is rendered nonuniform in the circumferential direction of the heating roller 2. The difficulty is brought about by the phenomenon that the magnetic flux is generated in a different intensity in the circumferential direction because of the reason inherent in the case of using an empty coil as the exciting coil 11 as in this embodiment.

Under the circumstances, it is necessary to narrow the temperature difference in the circumferential direction of the heating roller 2 to fall within a predetermined allowable range by the time immediately before the paper sheet P passes through the nip portion formed between the heating roller 2 and the pressurizing roller 3. Therefore, the heating roller 2 and the pressurizing roller 3 are rotated in order to make uniform the temperature distribution over the entire outer circumferential regions of these rollers 2 and 3 a predetermined time later, though the heating roller 2 and the pressurizing roller 3 are left stopped at, for example, the rising time of the fixing apparatus at which the current supply to the exciting coil 11 is started. As a result, a predetermined amount of heat is imparted to the entire outer circumferential region of each of these rollers 2 and 3.

The toner image formed in the image forming section is transferred at a predetermined timing at which the surface temperature of the heating roller 2 is elevated to reach 180° C., and the paper sheet P having the toner image electrostatically held thereon is transferred to the nip portion between the heating roller 2 and the pressurizing roller 3. When the paper sheet P passes through the nip portion, the toner image transferred onto the paper sheet P is fused and fixed to the paper sheet P.

To be more specific, a high frequency current is supplied to the exciting coil 11 by the driving circuit shown in FIG. 3. As a result, an eddy current is generated on the surface of the heating roller 2 by the magnetic field generated from the exciting coil 11 so as to generate the Joule current in the heating roller 2, thereby heating the heating roller 2.

In accordance with the temperature elevation on the surface of the heating roller 2, heat is generated as an infrared ray from the surface of the heating roller 2. Needless to say, if heat is emitted from the heating roller 2, the heat energy consumed for the heating of the heating roller 2 is decreased. Therefore, in order to promote the temperature elevation to permit the surface temperature of the heating roller 2 to reach 180° C., it is necessary to decrease the radiation heat generated from the heating roller 2. Such being the situation, the heat radiation toward the outside is suppressed by mounting a heat insulating member on the outside of the heating roller 2 or by molding the case of the fixing apparatus 58.

On the other hand, the heat radiation toward the inside of the heating roller 2 also gives rise to a problem that the radiated heat is absorbed by the covering tube 13 or the exciting coil 11 and, thus, is consumed for the warming of the exciting coil 11 and the covering tube 13. Incidentally, the infrared ray is absorbed by the exciting coil 11 and the covering tube 13 in an amount large enough to lower the temperature rising rate in the case of the heating roller 2 made of a pure iron sheet having a thickness of 1 mm as in this embodiment.

Under the circumstances, the wall thickness of the covering tube 13 is set at 0.3 mm and the covering tube 13 is colored white or gray so as to reflect the infrared ray, as described previously in conjunction with FIGS. 2A and 2C. As a result, the infrared ray radiated inside the heating roller 2 toward the exciting coil 11 is reflected from the covering tube 13. It follows that where the thickness of the covering tube 13 is increased in view of the dielectric strength relative to the exciting coil 11, the thickness of the covering tube 13 can be increased without changing the temperature rising time by coloring the covering tube to facilitate the reflection of the infrared ray.

If the thickness of the covering tube is decreased in an attempt to shorten the time required for the temperature elevation, the heat capacity of the covering tube is decreased and the insulating properties of the covering tube are lowered. As a result, problems are brought about that leakage takes place between the exciting coil 11 and the heating roller 2 and that the covering tube 13 covering the exiting coil 11 is peeled off. However, it is possible to set the thickness of the covering tube at an appropriate value, as required. Incidentally, the covering tube is formed of an electrically insulating material in this embodiment. However, it is also possible to use a heat insulating material for forming the covering tube 13. It is also possible to use a heat insulating material, which exhibits electrical insulating properties and is colored in a color capable of reflecting the infrared ray with a high reflectivity, thereby further shortening the temperature elevation time.

Figure 4:
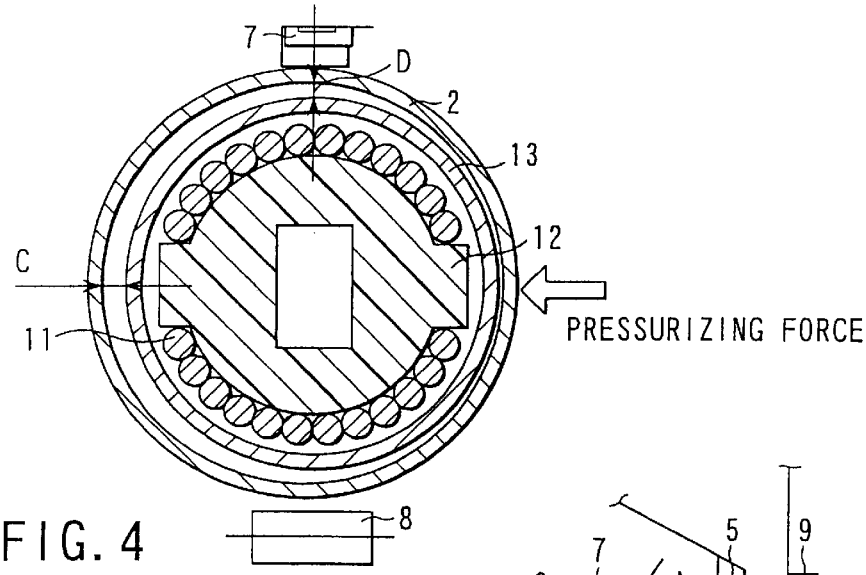
FIG.4 schematically shows how the heating roller is moved by application of a predetermined pressure to the heating roller of the fixing apparatus shown in FIGS. 2A, 2B, and 2C.

Also, as shown in FIGS. 2A and 2C, the thermistor 7 and the thermostat 8 are arranged in parallel to the direction in which pressure is applied to the heating roller 2. As a result, even if the heating roller 2 is moved to the left in the drawing relative to the center of the heating roller 2 by the pressure applied from the pressurizing mechanism 4, as shown in FIG. 4, the distance of each of the thermistor 7 and the thermostat 8 from each wire of the exciting coil 11 is left substantially unchanged, making it possible to detect accurately the surface temperature of the heating roller 2.

To be more specific, the thermistor 7 and the thermostat 8 are arranged in a direction and position substantially parallel to the direction in which pressure is applied to the heating roller 2 in the present invention. It should be noted in this connection that the pressurizing roller 3 is pressed against the heating roller 2 with a nonuniform pressure by the pressure generated from the pressurizing apparatus 4. As a result, the pressurizing force applied to the heating roller 2 is increased so as to bring about an error in the positional accuracy of the heating roller 2. If the error in the positional accuracy of the heating roller 2 is increased to exceed an allowable design range, i.e., if the position of the heating roller 2 is deviated by the backlash, a gap between the exciting coil 11 and the heating roller 2 is increased in portion C as shown in FIG. 4. It follows that, if the thermistor 7 or the thermostat 8 is mounted to portion C, the surface temperature of the heating roller 2 detected by the thermistor 7 or the thermostat 8 includes a large error, making it impossible to control the temperature of the heating roller 2.

On the other hand, where the thermistor 7 and the thermostat 8 are arranged in portion D, i.e., arranged in a direction substantially parallel to the direction in which pressure is applied to the heating roller 2, the gap between the exciting coil 11 and the heating roller 2 is very small even if the position of the heating roller 2 is deviated by the pressure applied from the pressurizing mechanism 4, compared with the case where the thermistor 7 and the thermostat 8 are arranged in portion C.

In an induction heating system in which a high frequency current is supplied to the exciting coil 11 so as to generate an eddy current in the heating roller 2 and, thus, to permit the heating roller 2 to generate heat, the amount of heat generated from the heating roller 2 is dependent on the magnitude of the gap between the exciting coil 11 and the heating roller 2. To be more specific, if the exciting coil 11 is positioned closer to the heating roller 2, the magnetic flux acting on the heating roller 2 is intensified so as to increase the eddy current generated in the heating roller 2. It follows that the amount of heat radiated from the heating roller 2 is increased with decrease in the gap between the exciting coil 11 and the heating roller 2.

Incidentally, the amount of heat generated from the heating roller 2 is inversely proportional to the square of the distance between the heating roller 2 and the exciting coil 11.

In the fixing apparatus 58 of the induction heating system, the allowable rising time between the stopped state (instruction for starting the heat generation) and the heating to a predetermined temperature is short. In addition, the thickness of the metal plate forming the heating roller 2 is small and has a small heat capacity, compared with the known heating roller utilizing a halogen lamp. Under the circumstances, it is necessary to control the gap between the heating roller 2 and the exciting coil 11 with a high accuracy. It follows that it is desirable for the thermistor 7 and the thermostat 8 to be arranged on the outer circumferential surface of the heating roller 2 in positions parallel to the direction in which pressure is applied to the heating roller 2, as described above.

Incidentally, on the circumferential surface of the heating roller 2, the heat is generated in the largest amount in the positions where the thermistor 7 and the thermostat 8 are arranged. To be more specific, the exciting coil 11 fixed within the heating roller 2 is prepared by bending a planar coil along the inner wall of the heating roller 2 and, thus, includes a portion A where the wire materials of the exciting coil 11 are arranged dense and a portion B where the wire materials of the exciting coil 11 are arranged sparse, as apparent from FIG. 5.

It follows that the amount of heat generated from the exciting coil 11 is large in the dense portion A of the wire materials, compared with the sparse portion B of the wire materials. Naturally, at the start up of the power supply (instruction for rising) during which the heating roller 2 is stopped, the surface temperature of the heating roller 2 is made higher in portion A where the heat generation amount is large, and the surface temperature of the heating roller 2 is made lower in portion B where the heat generation amount is small.

Figure 5:
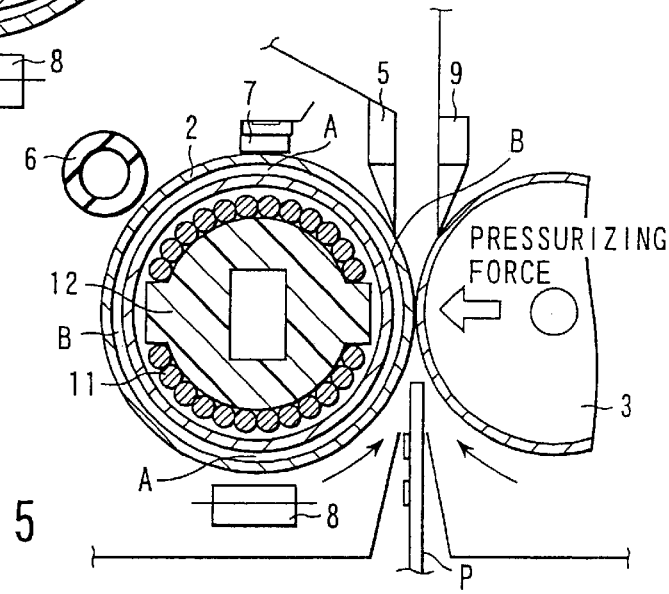
FIG. 5 schematically shows the nonuniform distribution of the wire materials of the exciting coil incorporated in the heating roller of the fixing apparatus shown in FIGS. 2A, 2B and 2C.

Under the circumstances, it is possible to grasp the maximum temperature in the circumferential direction of the heating roller 2 by arranging the thermistor 7 and the thermostat 8 in positions where the heat generation amount of the exciting coil 11 becomes largest, as shown in FIG. 5.

It should also be noted that the surface temperature of the heating roller 2 can be detected accurately without being affected by the change in the gap between the heating roller 2 and the exciting coil 11 so as to make it possible to control accurately the surface temperature of the heating roller 2. Further, even if the thermistor 7 is made inoperable by some reasons to cause the surface temperature of the heating roller 2 to reach an abnormal temperature, the abnormal temperature elevation of the heating roller 2 can be detected by the thermostat 8 so as to cut off the current supplied to the exciting coil 11. Therefore, even if the rotation of the heating roller 2 is stopped with the paper sheet P caught by the nip portion, it is possible to prevent the paper sheet P caught by the nip portion from being heated to an abnormally high temperature. Naturally, the paper sheet P is prevented from flaming.

For comparison, the thermostat 8 was fixed at portion B shown in FIG. 5, where the wire materials of the exciting coil 11 were arranged sparse, and the thermistor 7 was arranged in portion A where the wire materials of the exciting coil 11 were arranged dense. Under this condition, the temperature of the nip portion was found to be low, i.e., about 80° C., in the case where the thermostat 8 was operated under an abnormally high temperature.

Figure 6:
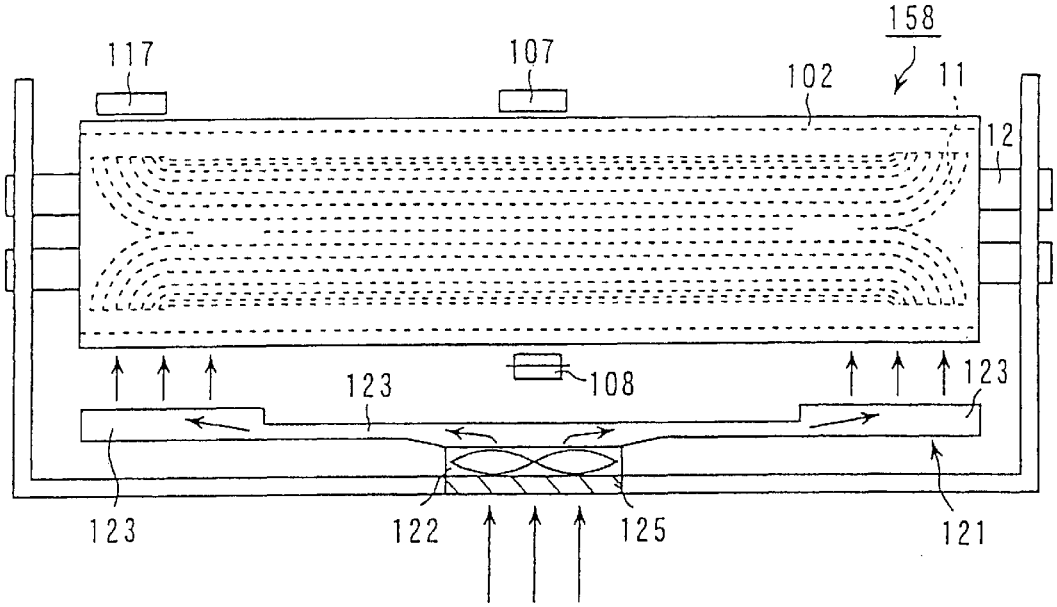
FIG. 6 shows in a magnified fashion a fixing apparatus differing from the fixing apparatus shown in FIGS. 2A,.2B and 2C together with the feature in the arrangement within the image forming apparatus.
Figure 7:
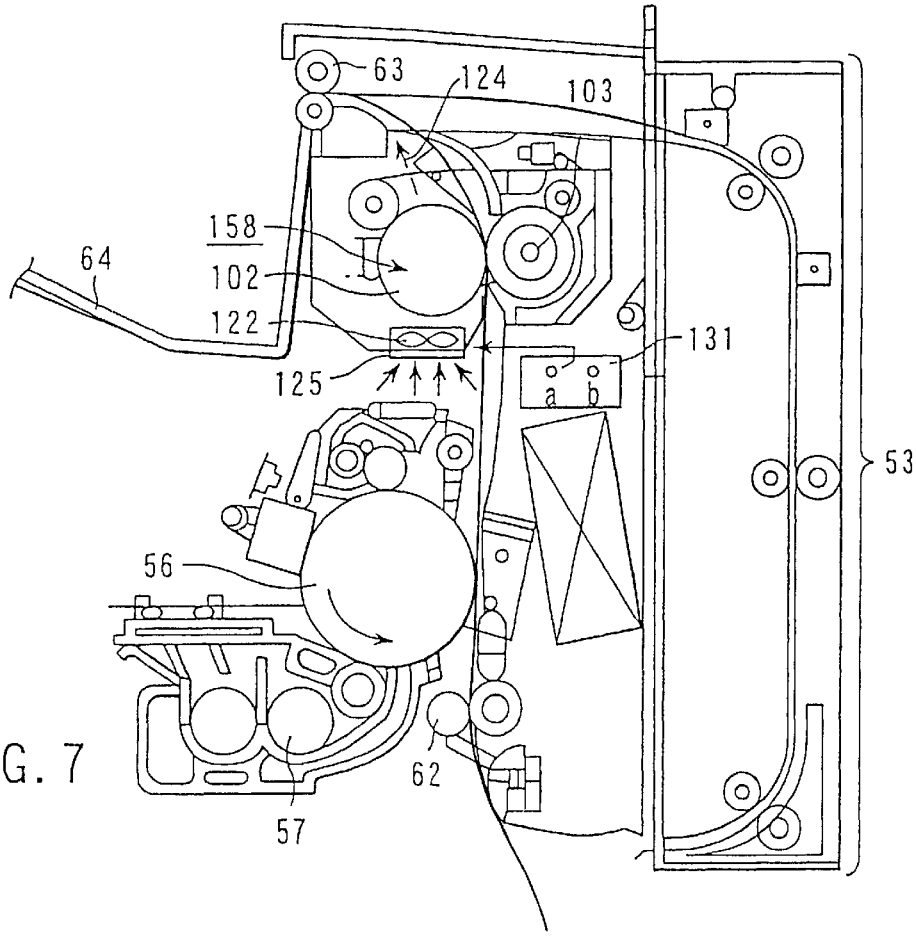
FIG. 7 is a side view schematically showing the fixing apparatus shown in FIG. 6 as viewed from the side of the pressurizing roller.
Figure 8:
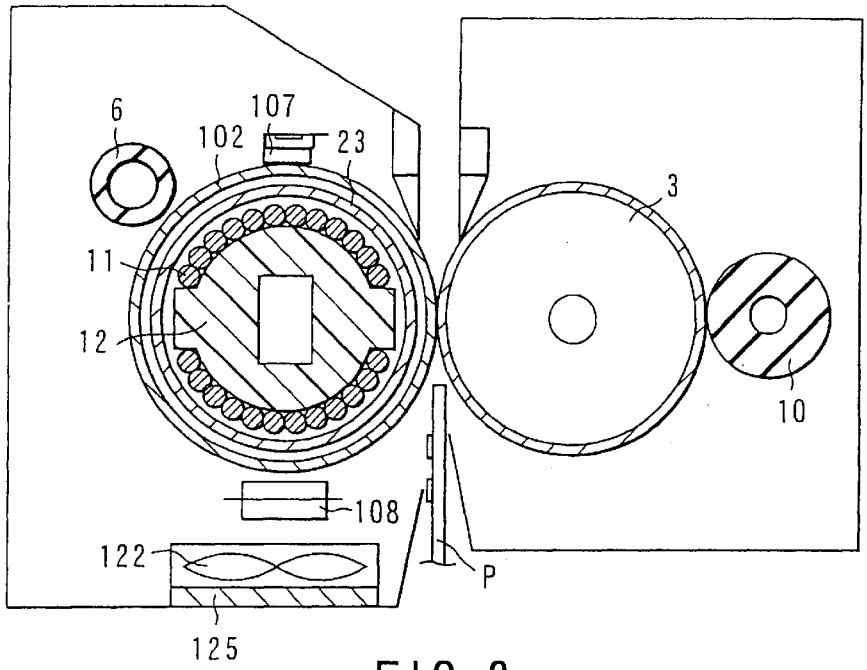
FIG. 8 is a cross sectional view schematically showing the fixing apparatus shown in FIGS. 6 and 7.

FIGS. 6, 7 and 8 schematically show embodiments differing from the fixing apparatus described previously in conjunction with FIGS. 2A, 2B and 2C. FIG. 6 shows the state that the fixing apparatus shown is FIG. 7 is observed from the left side. On the other hand, FIG. 8 is a cross sectional view schematically showing in a magnified fashion the fixing apparatus as viewed in a direction shown in FIG. 7. Detailed explanation is omitted in respect of the construction equal to that of the fixing apparatus shown in FIGS. 2A, 2B and 2C.

As shown in FIG. 6, a fixing apparatus 158 has a first roller (heating roller) 102, which is cylindrical body, i.e., an endless body, made of a metal sheet having a thickness of about 1 mm, and a second roller (pressurizing roller) 103 that is brought into contact with a single point on the circumferential surface of the heating roller 102.

The pressurizing roller 103 is pushed with a predetermined pushing force against the heating roller 102 by a pressurizing mechanism (not shown) so as to be temporarily deformed, thereby forming a nip portion between the heating roller 102 and the pressurizing roller 103. Incidentally, the heating roller 2 is rotated at a predetermined speed by a driving motor (not shown) such that the peripheral speed of the heating roller 2 is substantially equal to that of the photosensitive drum 56 included in the image forming section. The pressurizing roller 103 is also rotated in accordance with rotation of the heating roller 102 at a peripheral speed equal to that of the outer circumferential surface of the heating roller 102.

A first thermistor 107 for detecting the surface temperature in the central portion in the longitudinal direction of the heating roller 102, a second thermistor 117 for detecting the surface temperature in the edge portion in the longitudinal direction of the heating roller 102, and a thermostat 108 for detecting the abnormality of the temperature on the surface of the heating roller 102 se as to stop the heating (to cut off the power supply) are arranged on the circumferential surface of the heating roller 102 in positions downstream of the nip portion between the heating roller 102 and the pressurizing roller 102 in respect of the rotating direction of the heating roller 102. Incidentally, these thermistors 107, 117 and the thermostat 108 are arranged in positions parallel to the direction in which the pressurizing roller 103 is pushed by the pressurizing apparatus (not shown) against the outer circumferential surface of the heating roller 102.

A cooling mechanism 121 for cooling at least the both edge portions of the heating roller 102 is mounted in a predetermined position in the vicinity o f the heating roller 102. To be more specific, the cooling mechanism 121 is arranged right under the heating roller 102 under the state that the fixing apparatus 158 is set in the image forming apparatus 51, i.e., in the direction in which the heat generated from the apparatus and unit involved in the image formation such as the photosensitive drum 56 and the developing apparatus 57 is transferred upward. The cooling mechanism 121 has a fan 122 for forming a cool air and a duct 123 for guiding the cool air formed by the fan 122 to the both edge portions of the heating roller 102.

The cool air guided through the duct 123 to the heating roller 102 cools the edge portions of the heating roller 102 and, then, passes through an exhaust path 124 shown in FIG. 7 so as to cool the paper sheet P having a toner image fixed thereto in the fixing apparatus 158 and transferred toward the discharge tray 63 (discharge roller 63). Further, an ozone filter 125 for absorbing the ozone generated in the vicinity of the photosensitive drum 56 included in the image forming section is arranged on the suction side of the fan 122.

Incidentally, the fan 122 is a tap control type fan connected to a tap switching circuit 131 as shown in, for example, FIG. 7 so as to be rotatable at a first speed and at a second speed lower than the first speed. For example, the fan 122 is rotated at the first speed during the image forming operation in which the paper sheet P is transferred to the nip portion between the heating roller 102 and the pressurizing roller 103, and is rotated at the second speed in the ready time. It should be noted, however, that the timing of rotating the fan 122 is limited to the case where the image formation on the paper sheet P having a small width compared with the length of the heating roller 102 is carried out continuously so as to cause the temperature in the edge portions of the heating roller 102 to be elevated to exceed a predetermined temperature.

Figure 9:
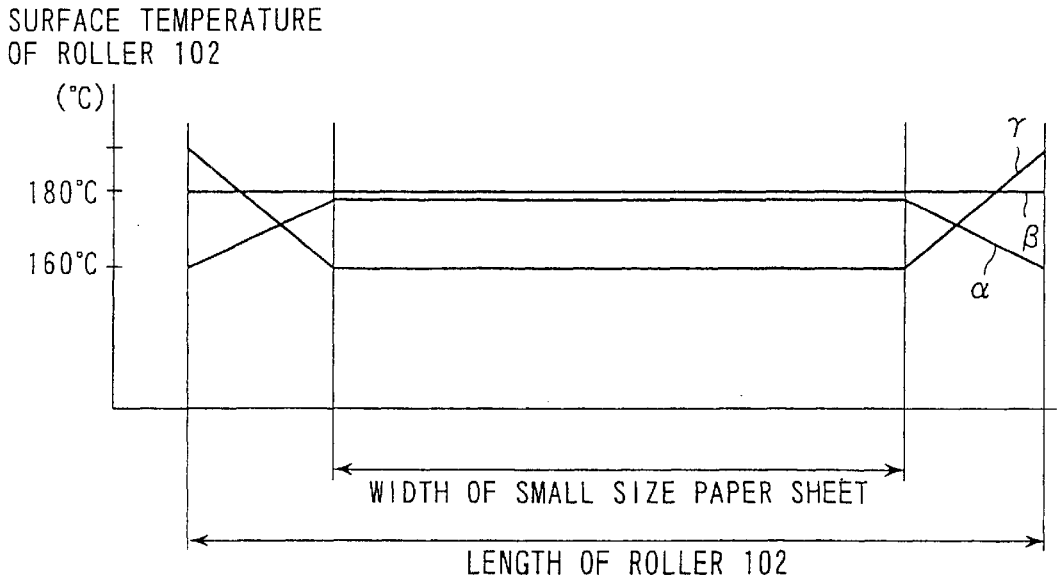
FIG. 9 is a graph for explaining the change in temperature in the longitudinal direction of the heating roller by the temperature control on the surface of the heating roller included in the fixing apparatus shown in FIGS. 6, 7 and 8.

The fixing apparatus 158 shown in FIGS. 6, 7 and 8 has a temperature distribution in the longitudinal direction of the heating roller 102 such that the temperature is low in both edge portions of the heating roller 102 as denoted by curve $\alpha$ in FIG. 9 immediately after the rising (start up of power supply to the exciting coil 11) or during the waiting time under the ready state after the temperature has been once elevated to reach 180° C. Incidentally, in order to obtain a sufficient fixing properties during the period between the initiation of the image forming operation and the time when the paper sheet P having a toner image transferred thereto is guided to the nip portion between the heating roller 102 and the pressurizing roller 103, the temperature in the edge portions of the heating roller 102 is set at a temperature at which the fixation can be achieved, i.e., at 160° C. in this embodiment, while monitoring the temperature in the edge portion of the heating roller 102 with the second thermistor 107. In this step, the temperature in the central portion of the heating roller 102 is about 180° C.

On the other hand, where image formation is repeatedly performed on the paper sheet P having a small width compared with the length of the heating roller 102, a predetermined current is supplied to the exciting coil 11 to permit the thermistor 107 to set the temperature in the central portion of the heating roller 102 at 180° C. while measuring the temperature in the longitudinal direction of the heating roller 102 by the first thermistor 107 and the second thermistor 117. In this case, however, the surface temperature is elevated in the edge portions of the heating roller 102 through which the paper sheet P is not transferred.

In the temperature control in the edge portions of the heating roller in the known fixing apparatus, the fan is rotated in general at the time when the temperature in the edge portions of the heating roller is elevated to reach a predetermined temperature. In this case, however, the temperature in the central portion of the roller is maintained constant. Therefore, in the known control method, in which the temperature in the central portion of the roller is determined on the basis of the temperature in the edge portions of the roller in the rising step or under the ready state, the temperature in the central portion is maintained at the initial value in spite of the temperature elevation in the edge portions. It follows that a problem is generated that the power consumption is increased.

Under the circumstances, this embodiment of the present invention is featured in that the fan 122 is operated when the difference between the temperature of the heating roller 102 detected by the second thermistor 117 (edge portion) and the temperature of the heating roller 102 detected by the first thermistor 107 (center) is larger than a predetermined value.

To be more specific, if the image formation on the paper sheet P of a small size is continued, the temperature in the edge portion of the heating roller 102 is gradually increased from −20° C., which is the state of the temperature distribution curve a shown in FIG. 9 under the ready state or immediately after the rising, i.e., the temperature of A–B, where A represents the temperature in the edge potion of the heating roller 102 detected by the second thermistor 117, and B represents the temperature in the center of the heating roller 102 detected by the first thermistor 107, to reach the state that the difference between the temperature in the center of the heating roller 102 and the temperature in the edge portion of the heating roller 102 is 0° C., as shown by curve 8 in FIG. 9. In other words, the output of the second thermistor 117 in the edge portion is increased to reach 180° C.

In this step, the temperature control in the central portion of the heating roller 102 performed by the first thermistor 107 is lowered by, for example, 5° C. so as to perform the temperature control at 175° C. (control temperature is lowered by 5° C.). Then, the value of A–B described above is obtained again. If the value of A–B is not lower than 0° C., the temperature control in the central portion of the heating roller 102 is further lowered by 5° C. Likewise, the operation for lowering the temperature in the central portion of the heating roller 102 by 5° C. is repeated until the temperature in the central portion of the heating roller 102 is lowered to reach a critical temperature of 160° C. at which the fixing operation can be performed.

However, even if the temperature in the central portion of the heating roller 102 is lowered to reach 160° C., the temperature in the edge portion of the heating roller 102 continues to be elevated because the paper sheet P is not transferred through the edge portion. Therefore, the fan 122 is rotated at the time when the temperature in the central portion of the heating roller 102 is lowered to reach 160° C. and when the value of A–B described above has become not lower than A° C. (predetermined inclination) as denoted by curve y in FIG. 9. The rotating speed of the fan 122 is dependent on the control step inherent in the fan 122. Where the difference between the temperature detected by the second thermistor 117 and the temperature detected by the first thermistor 107 has a predetermined inclination not lower than AC, an optimum rotating speed (control step) of the fan 122 is determined to conform with the inclination. In this case, it is possible to prevent the surface temperature of the heating roller 102 from being undesirably lowered. It is also possible to lower the power consumption of the fan 122.

As described above, where the image forming operation is continued on the paper sheet P having a width smaller than the length of the heating roller 102, the temperature in the central portion of the heating roller 102 is successively changed to the critical control temperature at which the fixing treatment can be performed, as shown in FIG. 9. What should be noted is that the fan 122 is operated by calculating the difference between the temperature detected by the first thermistor 107 and the temperature detected by the second thermistor 117 only when the temperature in the edge portion of the heating roller 102 continues to be elevated. As a result, the power consumption of the fan 122 can be suppressed to the lowest level. In addition, the heat generated from the heating roller 102 can be effectively utilized. It should also be noted that the ozone filter 125 is mounted to the suction side of the fan 122, as described previously. Therefore, it is possible to suppress the release of ozone, which is generated from the charging device (not shown) or transfer device (not shown) arranged around the photosensitive drum 56 and generating a high negative voltage, to the outside of the image forming apparatus 51. Also, the paper sheet P having a toner image fixed thereto by the fixing apparatus 158 and transferred toward the discharge tray 64 (discharge roller 63) is cooled by the cool air, which was guided through the exhaust path 124 so as to cool the heating roller 102. As a result, the paper sheet P having the toner image fixed thereto is cooled when guided into a double-sided image forming unit, which is not described in detail, within a paper feeding mechanism 53. The paper sheet P is cooled to a temperature at which the part not having a high heat resistance within the double-sided unit is not affected even if the paper sheet P is brought into contact with the particular part. For example, the paper sheet P is cooled to a temperature at which the user touching the paper sheet P does not feel warm.

As clearly shown in FIG. 7, the fan 122 permits inhibiting the diffusion of the heat generated in the fixing apparatus toward the photosensitive drum 56 that is present in the upper limit of temperature operable as a light semiconductor. As a result, it is possible to prevent the toner from being attached to the photosensitive drum 56 and to prevent the blocking of the toner within the developing apparatus 57 so as to suppress the undesired blurring.

As described above, the present invention makes it possible to control the surface temperature of the heating roller accurately in the fixing apparatus of an induction heating system.

It should be noted that, even if it has become impossible to control the surface temperature of the heating roller so as to cause the heating roller to be heated to an abnormally high temperature, the abnormality is detected in the present invention on the basis of the heat at the largest heat generating portion on the surface of the heating roller. Naturally, the detected temperature is higher than the temperature in the nip portion between the heating roller and the pressurizing roller. It follows that, even if the apparatus is stopped with the paper sheet held in the nip portion, the paper sheet is prevented from being heated to an abnormally high temperature and, thus, is prevented from flaming.

It should also be noted that, where the image formation on the paper sheet having a width smaller than the length of the heating roller is performed continuously, the temperature in the central portion of the heating roller in contact with the paper sheet is maintained at a critical temperature at which the fixing treatment can be performed. Also, the fan is rotated as required in order to suppress the temperature elevation in the edge portion of the heating roller. It follows that it is possible to suppress the power consumption while effectively utilizing the heat generated from the heating roller. Also, the heat of the heating roller is prevented from being diffused toward the photosensitive drum by the cool air produced by the rotation of the fan. In addition, the heat of the paper sheet is removed by the discharge of the cool air. What should also be noted is that an ozone filter is incorporated in the fan, making it possible to prevent ozone, which is generated on the side of the photosensitive drum by the presence of negative ions, from being released to the outside of the apparatus.

Each of the embodiments described above is directed to a fixing apparatus of an induction heating type. Needless to say, however, various known heat generating bodies such as a halogen lamp and a planar heat generating body can be used for heating the heat generating roller.

What is claimed is:

1. A fixing apparatus, comprising:

an endless member having a metal layer made of a conductor and rotatable in an optional direction;

a pressurizing member serving to apply a predetermined pressure to said endless member;

an induction heating apparatus arranged in the vicinity of said endless member so as to heat the endless member;

a temperature detecting apparatus for detecting the temperature of the endless member, said temperature detecting apparatus being arranged at a point of about 90° along the outer circumferential surface of the endless member from the pressurizing point at which said pressurizing member applies pressure to the endless member; and an abnormal temperature detecting apparatus for detecting the temperature of said endless member, said abnormal temperature detecting apparatus being arranged at a point of about 90° along the outer circumferential surface of the endless member from the pressurizing point at which said pressurizing member applies pressure to the endless member.

2. The fixing apparatus according to claim 1, wherein said abnormal temperature detecting apparatus is positioned upstream of said pressurizing point at which said pressurizing member applies pressure to the endless member.

3. A fixing apparatus, comprising:

an endless member having a metal layer made of a conductor and rotatable in an optional direction;

a pressurizing member serving to apply a predetermined pressure to said endless member;

an induction heating apparatus arranged in the vicinity of said endless member so as to heat the endless member, said induction heating apparatus comprising a planar coil wound in the circumferential direction of said endless member; and an abnormal temperature detecting apparatus for detecting the temperature of the endless member, said temperature detecting apparatus being arranged at a point of about 90° along the outer circumferential surface of the endless member from the pressurizing point at which said pressurizing member applies pressure to the endless member, wherein said temperature detecting apparatus is positioned at a point where the endless member generates the largest amount of heat when the endless member, which is stopped, is heated by said induction heating apparatus.

4. The fixing apparatus according to claim 3, wherein said abnormal temperature detecting-apparatus detects the abnormality of the surface temperature of said endless member in a plane substantially parallel to the direction in which said endless member is pushed by said pressurizing member.

5. A fixing apparatus, comprising:

an endless member having a metal layer made of a conductor and rotatable in an optional direction;

a pressurizing member serving to apply a predetermined pressure to said endless member;

an induction heating apparatus arranged in the vicinity of said endless member so as to heat the endless member;

a first temperature detecting apparatus arranged in that position on the surface of the endless member through which passes the minimum size of a transferred material so as to detect the temperature of the endless member;

a second temperature detecting apparatus arranged outside that region on the surface of the endless member through which passes the maximum size of a transferred material so as to detect the temperature of the endless member; and cooling means having at least one of a fan and a fan provided with a filter for cooling the edge portion of the endless member in accordance with the difference between the temperatures detected by said first temperature detecting apparatus and said second temperature detecting apparatus, wherein:

when the difference between the temperatures detected by said first and second temperature detecting apparatuses exceeds a predetermined value, power supplied to said induction heating apparatus is gradually reduced until the first temperature detecting apparatus detects a lowest possible fixing temperature; and when said first temperature detecting apparatus detects the lowest possible fixing temperature, and the difference between the temperatures detected by said first and second temperature detecting apparatuses still exceeds the predetermined value, said cooling means is operated during a predetermined time period.

6. The fixing apparatus according to claim 5, wherein said cooling means gradually lowers the temperature control value detected by said first temperature detecting apparatus and, after the critical temperature at which the fixation can be performed is detected by said first temperature detecting apparatus and after the difference between the temperature detected by said first temperature detecting apparatus and the temperature detected by said second temperature detecting apparatus has reached a predetermined temperature, serves to cool the edge portion of said endless member.

7. A fixing apparatus comprising:

an endless member having a metal layer made of a conductor and rotatable in an optional direction;

a pressurizing member serving to apply a predetermined pressure to said endless member;

an induction heating apparatus arranged in the vicinity of said endless member so as to heat the endless member;

a first temperature detecting apparatus arranged in that position on the surface of the endless member through which passes the minimum size of a transferred material so as to detect the temperature of the endless member;

a second temperature detecting apparatus arranged outside that region on the surface of the endless member through which passes the maximum size of a transferred material so as to detect the temperature of the endless member; and cooling means for cooling the edge portion of the endless member in accordance with the difference in temperatures detected by said first temperature detecting apparatus and said second temperature detecting apparatus, wherein said cooling means is rotated at a first speed when a transferred material is transferred to a nip portion between said endless member and said pressurizing member, and is rotated at a second speed lower than said first speed when a transferred material is not transferred to said nip portion between said endless member and said pressurizing member.

8. The fixing apparatus according to claim 7, wherein said cooling means gradually lowers the temperature detected by said first temperature detecting apparatus and, after the critical temperature at which the fixation can be performed is detected by said first temperature detecting apparatus, is rotated in accordance with the difference between the temperature detected by said first temperature detecting apparatus and the temperature detected by said second temperature detecting apparatus at any of the timing when the temperature detected by said first temperature detecting apparatus is gradually lowered to permit said first temperature detecting apparatus to detect the critical temperature at which the fixation can be performed, and when the difference between the temperature detected by the first temperature detecting apparatus and the temperature detected by the second temperature detecting apparatus has reached a predetermined temperature.

9. A fixing apparatus comprising:

an endless member having a metal layer made of a conductor and rotatable in an optional direction;

a pressurizing member serving to applying a predetermined pressure to said endless member;

an induction heating apparatus arranged in the vicinity of said endless member so as to heat the endless member;

a first temperature detecting apparatus arranged in that position on the surface of the endless member through which passes the minimum size of a transferred material so as to detect the temperature of the endless member;

a second temperature detecting apparatus arranged outside that region on the surface of the endless member through which passes the maximum size of a transferred material so as to detect the temperature of the endless member; and cooling means, having at least one of a fan and a fan provided with a filter, for cooling the edge portion of the endless member in accordance with the difference between the temperatures detected by said first temperature detecting apparatus and said second temperature detecting apparatus, wherein:

when the difference between the temperatures detected by said first and second temperature detecting apparatuses exceeds a predetermined value, power supplied to said induction heating apparatus is gradually reduced until the first temperature detecting apparatus detects a lowest possible fixing temperature; and when said first temperature detecting apparatus detects the lowest possible fixing temperature, and the difference between the temperatures detected by said first and second temperature detecting apparatuses still exceeds the predetermined value, said cooling means is operated during a predetermined time period on the basis of the difference between the temperatures detected by said first and second temperature detecting apparatuses.

10. The fixing apparatus according to claim 9, wherein said cooling means includes a fan and an ozone filter.

11. The fixing apparatus according to claim 10, wherein said cooling means gradually lowers the temperature detected by said first temperature detecting apparatus and, after the critical temperature at which the fixation can be performed is detected by said first detecting apparatus, serves to cool the edge portion of said endless member in accordance with the difference between the temperature detected by said first temperature detecting apparatus and the temperature detected by said second temperature detecting apparatus.

12. An image forming apparatus, comprising:

a photosensitive body holding a latent image;

a developing apparatus for supplying a developing agent onto said latent image formed on said photosensitive body so as to visualize said latent image;

a transfer apparatus for transferring the developing agent image formed on said photosensitive body by said developing apparatus onto a transferred material;

a fixing apparatus including (i) an endless member having a metal layer made of a conductor and rotatable in an optional direction, (ii) a pressurizing member serving to apply a predetermined pressure to said endless member, (iii) an induction heating apparatus arranged in the vicinity of said endless member so as to heat the endless member, (iv) a first temperature detecting apparatus arranged in that position on the surface of the endless member through which passes the minimum size of a transferred material so as to detect the temperature of the endless member, and (v) a second temperature detecting apparatus arranged outside that region on the surface of the endless member through which passes the maximum size of a transferred material so as to detect the temperature of the endless member;

control means for controlling power supplied to the induction heating apparatus of said fixing apparatus; and cooling means, having at least one of a fan and a fan provided with a filter, for cooling the edge portion of the endless member in accordance with the difference between the temperatures detected by the first temperature detecting apparatus and the second temperature detecting apparatus, wherein:

when the difference between the temperatures detected by the first and second temperature detecting apparatuses exceeds a predetermined value, said control means controls the power supplied to the induction heating apparatus to gradually reduce the power, until the first temperature detecting apparatus detects a lowest possible fixing temperature; and when the first temperature detecting apparatus detects the lowest possible fixing temperature, and the difference between the temperatures detected by the first and second temperature detecting apparatuses still exceeds the predetermined value, said cooling means is operated during a predetermined time period.

13. The fixing apparatus according to claim 12, wherein said cooling means gradually lowers the temperature detected by said first temperature detecting apparatus and, after the critical temperature at which the fixation can be performed is detected by said first temperature detecting apparatus and after the difference between the temperature detected by said first temperature detecting apparatus and the temperature detected by said second temperature detecting apparatus has reached a predetermined temperature, serves to cool the edge portion of said endless member.

14. The fixing apparatus according to claim 13, wherein said cooling means is rotated at a first speed when a transferred material is transferred to a nip portion between said endless member and said pressurizing member, and is rotated at a second speed lower than said first speed when a transferred material is not transferred to said nip portion between said endless member and said pressurizing member.

15. The fixing apparatus according to claim 12, wherein said cooling means gradually lowers the temperature detected by said first temperature detecting apparatus and, after the critical temperature at which the fixation can be performed is detected by said first temperature detecting apparatus, is rotated in accordance with the difference between the temperature detected by said first temperature detecting apparatus and the temperature detected by said second temperature detecting apparatus at any of the timing when the temperature detected by said first temperature detecting apparatus is gradually lowered to permit said first temperature detecting apparatus to detect the critical temperature at which the fixation can be performed, and when the difference between the temperature detected by the first temperature detecting apparatus and the temperature detected by the second temperature detecting apparatus has reached a predetermined temperature.

16. An image forming apparatus comprising:

a photosensitive body holding a latent image;

a developing apparatus for supplying a developing agent onto said latent image formed on said photosensitive body so as to visualize said latent image;

a transfer apparatus for transferring the developing agent image formed on said photosensitive body by said developing apparatus onto a transferred material;

a fixing apparatus having an endless member including a metal layer formed of a conductor and rotatable in an optical direction, a pressurizing member for applying a predetermined pressure to said endless member, and a heating device arranged in the vicinity of the endless member for heating the endless member, the transferred material having said developing agent image transferred thereto by said transfer apparatus and the developing agent image itself being heated and pressurized so as to fix the developing agent image onto the transferred material;

a cooling apparatus arranged between a first member selected from the endless member and the heating device of the fixing apparatus and a second member selected from the photosensitive body, the developing apparatus and the transfer apparatus, said first member being positioned closest to said second member, for cooling the edge portion of the endless member and apparatus positioned closest to said second member;

a first temperature detecting apparatus arranged on the surface of said endless member in a position where the minimum size of the transferred material passes and serving to detect the temperature of the endless member; and a second temperature detecting apparatus arranged on the surface of said endless member outside the region where the maximum size of the transferred material passes and serving to detect the temperature of the endless member;

wherein said cooling apparatus is operated in accordance with the difference between the temperature detected by said first temperature detecting apparatus and the temperature detected by said second temperature detecting apparatus.

17. An image forming apparatus comprising:

a photosensitive body holding a latent image;

a developing apparatus for supplying a developing agent onto said latent image formed on said photosensitive body so as to visualize said latent image;

a transfer apparatus for transferring the developing agent image formed on said photosensitive body by said developing apparatus onto a transferred material;

a fixing apparatus including (i) an endless member having a metal layer made of a conductor and rotatable in an optional direction, (ii) a pressurizing member serving to apply a predetermined pressure to said endless member, (iii) an induction heating apparatus arranged in the vicinity of said endless member so as to heat the endless member, (iv) a first temperature detecting apparatus arranged in that position on the surface of the endless member through which passes the minimum size of a transferred material so as to detect the temperature of the endless member, and (v) a second temperature detecting apparatus arranged outside that region on the surface of the endless member through which passes the maximum size of a transferred material so as to detect the temperature of the endless member;

control means for controlling power supplied to the induction heating apparatus of said fixing apparatus; and cooling means, having at least one of a fan and a fan provided with a filter, for cooling the edge portion of the endless member in accordance with the difference between the temperatures detected by the first temperature detecting apparatus and the second temperature detecting apparatus, wherein:

when the difference between the temperatures detected by the first and second temperature detecting apparatuses exceeds a predetermined value, the power supplied to said induction heating apparatus is gradually lowered until the first temperature detecting apparatus detects a lowest possible fixing temperature; and when the first temperature detecting apparatus detects the lowest possible fixing temperature, and the difference between the temperatures detected by said first and second temperature detecting apparatuses still exceeds the predetermined value, said cooling means is operated during a predetermined time period on the basis of the difference between the temperatures detected by the first and second temperature detecting apparatuses.

18. The image forming apparatus according to claim 17, wherein said cooling means gradually lowers the temperature detected by said first temperature detecting apparatus and, after the critical temperature at which the fixation can be performed is detected by said first temperature detecting apparatus, serves to cool the edge portion of said endless member in accordance with the difference between the temperature detected by said first temperature detecting apparatus and the temperature detected by said second temperature detecting apparatus.

19. The fixing apparatus according to claim 18, wherein said cooling means is rotated at a first speed when a transferred material is transferred to a nip portion between said endless member and said pressurizing member, and is rotated at a second speed lower than said first speed when a transferred material is not transferred to said nip portion between said endless member and said pressurizing member.

20. The fixing apparatus according to claim 18, wherein said cooling means gradually lowers the temperature control value detected by said first temperature detecting apparatus and, after the critical temperature at which the fixation can be performed is detected by said first temperature detecting apparatus, is rotated in accordance with the difference between the temperature detected by said first temperature detecting apparatus and the temperature detected by said second temperature detecting apparatus at any of the timing when the temperature control value detected by said first temperature detecting apparatus is gradually lowered to permit said first temperature detecting apparatus to detect the critical temperature at which the fixation can be performed, and when the difference between the temperature detected by the first temperature detecting apparatus and the temperature detected by the second temperature detecting apparatus has reached a predetermined temperature.

21. A fixing apparatus, comprising:

an endless member having a metal layer made of a conductor and rotatable in an optional direction;

a pressurizing member serving to apply a predetermined pressure to the endless member;

an induction heating apparatus provided in the vicinity of the endless member so as to heat the endless member;

a first temperature detecting apparatus provided in that position on the surface of the endless member through which a transferred material of the minimum size passes, so as to detect the temperature of the endless member;

a second temperature detecting apparatus provided outside that region on the surface of the endless member through which a transferred material of the maximum size passes, so as to detect the temperature of the endless member; and cooling means having at least one of a fan and a fan provided with a filter for cooling an edge portion of the endless member in accordance with the difference between the temperatures detected by the first temperature detecting apparatus and the second temperature detecting apparatus, wherein when the difference between the temperatures detected by the first and second temperature detecting apparatuses exceeds a predetermined value, the cooling means cools the edge portion of the endless member until the difference is equal to or lower than the predetermined value.

22. A method for controlling a temperature of a fixing apparatus which comprises (i) an endless member extending in a first direction, and rotatable in a second direction perpendicular to the first direction, (ii) a heater member comprising a planar coil formed of wire, a main portion of the planar coil being located parallel to the first direction, the heater member located along an inner periphery of the endless member without contacting the endless member, (iii) a first temperature sensor for detecting a temperature of that portion of the endless member which are other than edge portions there of in the first direction, (iv) a second temperature sensor for detecting a temperature of at least one of the edge portions of endless member, and (v) a cooling member for cooling the endless member, the method comprising the steps of:

detecting an output of the first temperature sensor and an output of the second temperature sensor;

reducing current to be supplied to a heater member, when the temperature detected by the first temperature falls within a range between an allowable maximum temperature of the endless member and a lower limit temperature of the endless member for a fixing operation; and operating the cooling member until a difference between the temperatures detected by the first and second temperature sensors is lower than a predetermined value. when the difference exceeds the predetermined value.

* * * * *